US007216775B2

(12) United States Patent
Evans et al.

(10) Patent No.: US 7,216,775 B2
(45) Date of Patent: May 15, 2007

(54) MOIST TOWELETTE PACKAGING

(75) Inventors: Christopher T. Evans, Long Valley, NJ (US); Christopher Gieda, Long Valley, NJ (US); David Schultz, Northborough, MA (US); Paul Bertram, Franklin, MA (US)

(73) Assignee: Union Street Brand Packaging, Flanders, NJ (US)

( * ) Notice: Subject to any disclaimer, the term of this patent is extended or adjusted under 35 U.S.C. 154(b) by 291 days.

(21) Appl. No.: 10/798,892

(22) Filed: Mar. 12, 2004

(65) Prior Publication Data

US 2005/0205594 A1 Sep. 22, 2005

Related U.S. Application Data

(60) Provisional application No. 60/490,938, filed on Jul. 30, 2003, provisional application No. 60/457,937, filed on Mar. 28, 2003, provisional application No. 60/453,553, filed on Mar. 12, 2003.

(51) Int. Cl.
*B65H 1/00* (2006.01)

(52) U.S. Cl. ..... 221/63; 221/33; 221/45; 221/267

(58) Field of Classification Search ..... 221/63, 221/36, 37, 247, 255, 49, 62, 303, 307, 309, 221/310, 33, 50, 47, 61, 102, 185, 257, 26, 221/260, 210; 206/494, 210, 397, 581, 409, 206/205; 220/253, 375
See application file for complete search history.

(56) References Cited

U.S. PATENT DOCUMENTS 3,967,756 A 7/1976 Barish
3,982,659 A * 9/1976 Ross ..... 221/63
4,601,938 A 7/1986 Deacon et al.
D315,671 S 3/1991 Zaragoza
5,542,567 A 8/1996 Julius
5,718,353 A * 2/1998 Kanfer et al. ..... 221/63
6,145,782 A 11/2000 King et al.
6,152,322 A 11/2000 Marino
6,158,614 A 12/2000 Haines et al.
6,214,784 B1 4/2001 Robbins et al.
6,306,810 B1 10/2001 Cheung et al.
6,328,252 B1 12/2001 Neveu et al.
6,412,656 B1 7/2002 Placik
6,440,916 B1 8/2002 Cheung et al.
6,514,923 B1 2/2003 Cheung et al.
D471,440 S 3/2003 Sams et al.

(Continued)

*Primary Examiner*—Gene O. Crawford
*Assistant Examiner*—Timothy Waggoner
(74) *Attorney, Agent, or Firm*—James Creighton Wray

(57) ABSTRACT

The new invention allows for easy retrieval of fall backs and eases the initial threading process upon initial opening/use of the package. Threading is done without removing the cap. Several of the embodiments allow refills to be inserted into the canister without removing the lid/cap. The layout of the dispensing system and the geometry and shape of the dispensing orifice/aperture minimize and mitigate product fall backs. The new invention improves performance of the orifices/apertures through unique geometry and shape as well as using different materials from existing products or the combination of multiple materials. Varying orifice diameter, co-molded density and stiffness or geometry of the actual lobes defining the dispensing aperture allows the precise amount of friction to be created in the dispensing opening for selectively grabbing or releasing the towelette, thereby tearing the towelette connecting perforations at just the right time.

20 Claims, 11 Drawing Sheets

U.S. PATENT DOCUMENTS 6,786,447 B2 * 9/2004 Geib et al. ..... 242/588.3
6,910,579 B2 * 6/2005 Reinke et al. ..... 206/494
2002/0179627 A1 12/2002 Huang et al.
2003/0221986 A1 12/2003 Reinke et al.

* cited by examiner

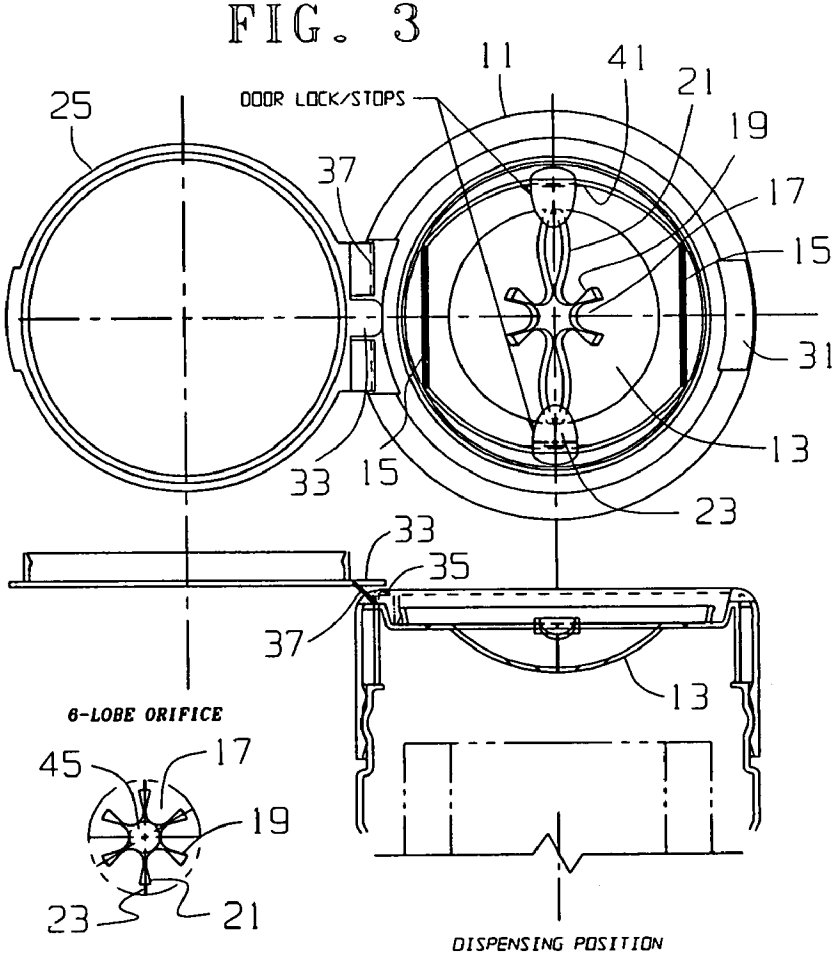
FIG. 3
FIG. 4
FIG. 5
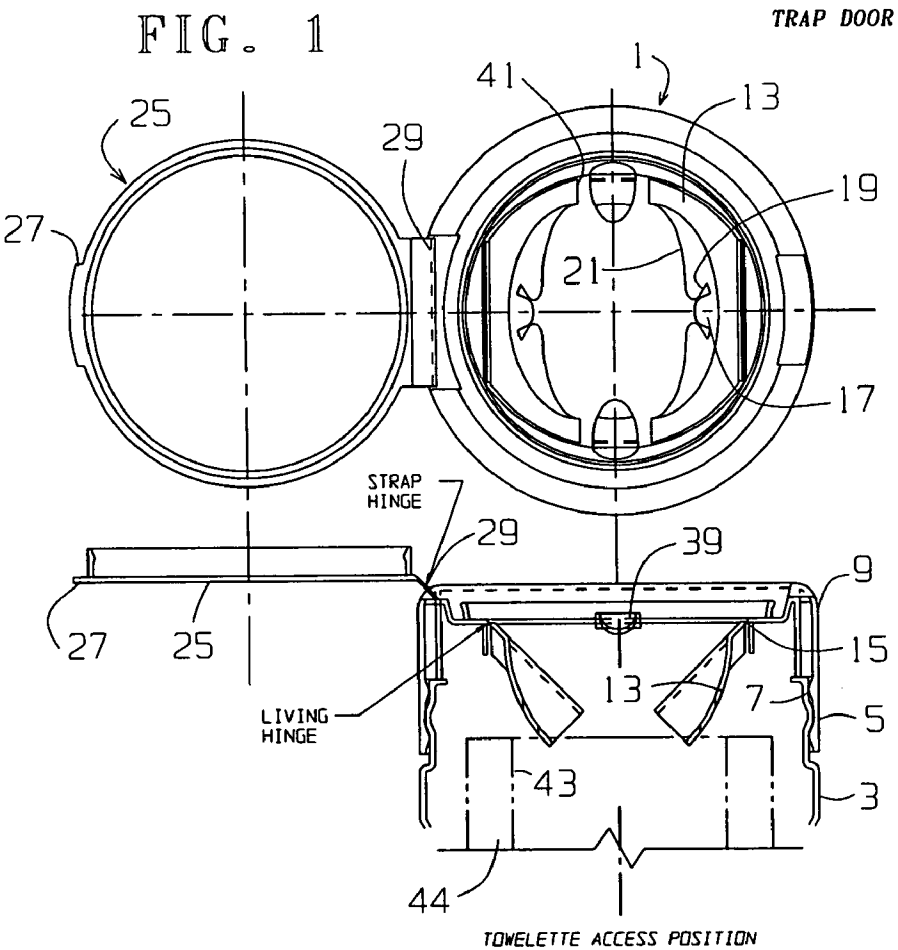
FIG. 1
FIG. 2

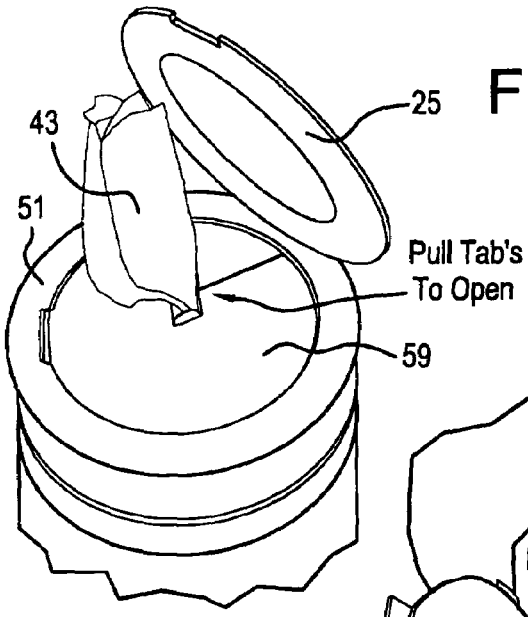
FIG. 9
FIG. 10
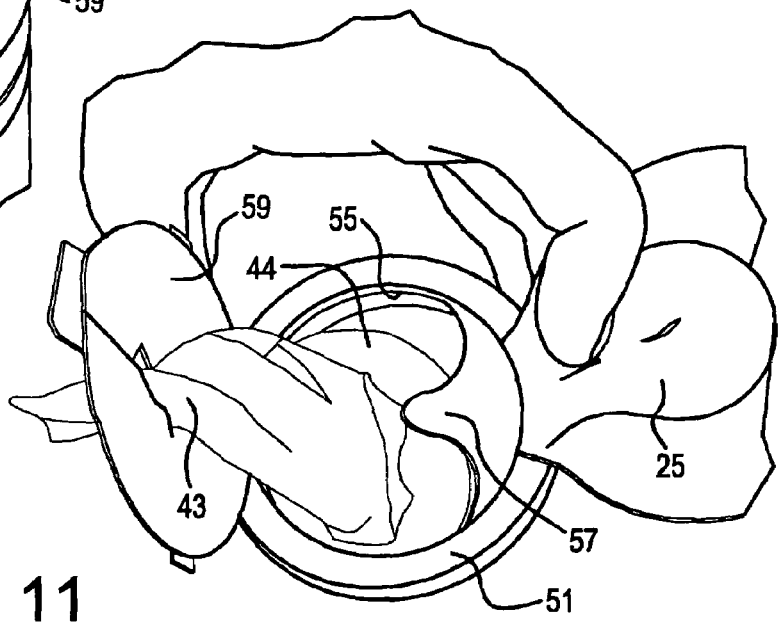
FIG. 11
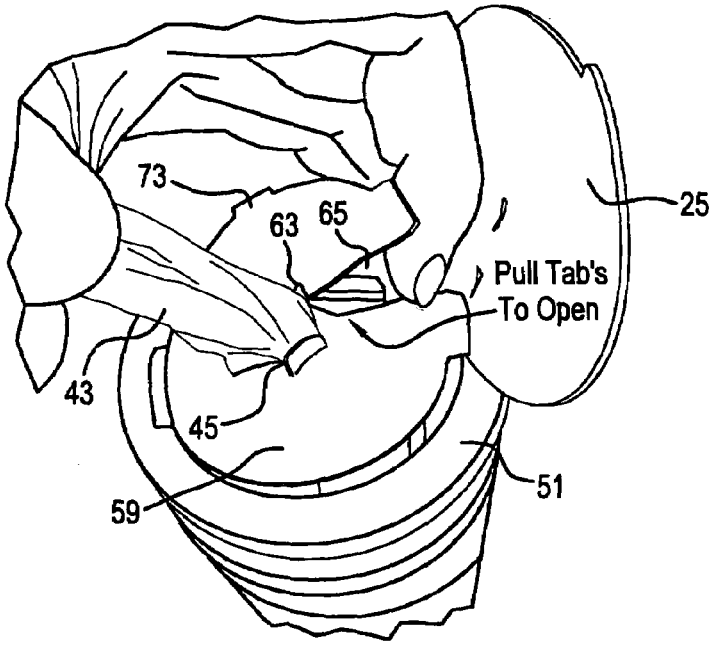

TELESCOPING

*TPE ORIFICE*

*OFFSET ORIFICE*

*DIFFERENT LOBE DESIGNS*
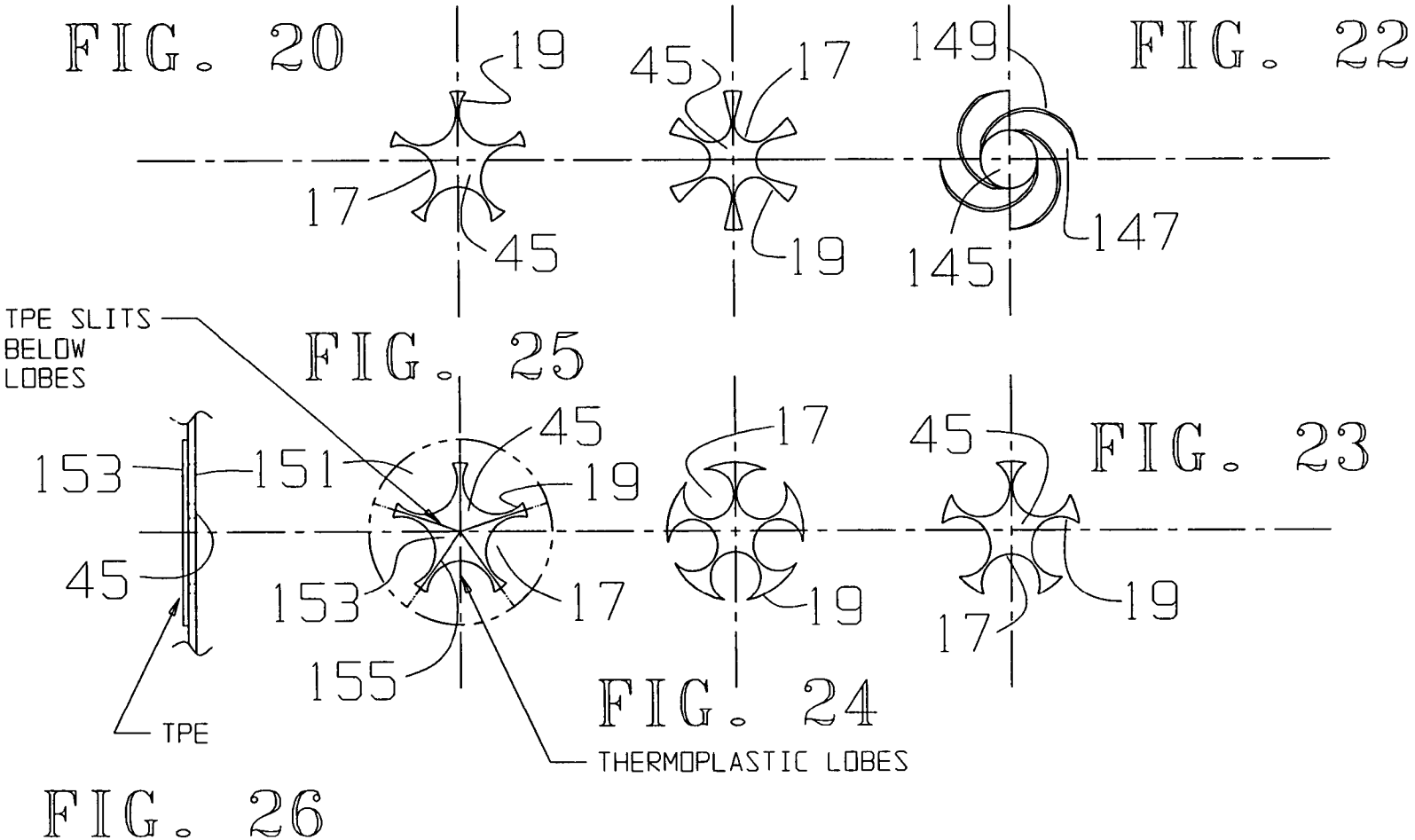

*SINGLE DOOR*

*SINGLE TRAP DOOR, WIDE OPENING.*

MOIST TOWELETTE PACKAGING

This application claims the benefit of U.S. Provisional Application No. 60/453,553 filed Mar. 12, 2003, U.S. Provisional Application No. 60/457,937 filed Mar. 28, 2003, and U.S. Provisional Application No. 60/490,938 filed Jul. 30, 2003.

BACKGROUND OF THE INVENTION

Moist towelettes are commonly sold and used in consumer product markets. Many methods exist for packaging moist towelettes. However, there are no packages that have adequate dispensing mechanisms. Wipes and moist towelettes are packaged as center dispensing rolls in cylindrical containers or as stacks of individual horizontal towelettes.

Many existing packaging systems for moist towelettes either have no dispensing mechanism, or if there is a dispensing mechanism, then it has too many limitations that inhibit functionality and ease of use.

Current packages attempt to let customers remove one towelette at a time. Normally, the subsequent wipe in a package hangs out from the package for easy grasping. However, should the next wipe fall back through the orifice in the cap and into the canister, current technology requires the user to pull the cap off. This is often very difficult to do. The consumer must then re-thread the wipe through the cap orifice, and then re-apply the cap to the canister for further single towelette dispensing. This is the same activity that a consumer must go through for first dispense of the package also.

When using the moist towelettes, hands of a user often become contaminated with substances. Reopening the container, then finding and leading an end of a towelette through a dispensing orifice are difficult when the dispensing interruption occurs before completing a cleaning operation.

Needs exist for improved methods for dispensing and storing moist towelettes that allows for easy dispensing.

SUMMARY OF THE INVENTION

The new invention is intended to allow for easy retrieval of "fallbacks", as well as easing the initial "threading" process one must go through upon initial opening/use of the package. The new invention allows threading to be done without removing the cap. Also, several of the new embodiments allow refills to be inserted into the canister without removing the lid/cap. The layout of the dispensing system and the geometry and shape of the dispensing orifice/aperture minimize and mitigate product fallbacks.

The new invention improves performance of the orifices/apertures through unique geometry and shape as well as using different materials from existing products, or the combination of multiple materials, such as hard thermoplastic molded substrate surrounding the orifice structure, with co-molded rubber-like material filling the void or aperture center. Varying orifice diameter, co-molded density and stiffness or geometry of the actual lobes defining the dispensing aperture allow the precise amount of friction to be created in the dispensing opening for selectively grabbing or releasing the towelette, thereby tearing towelette connection perforations at just the right time. That maximizes dispensing performance, and does not necessarily require the user to pull the towelettes up at an angle, as is suggested by current alternative dispensers, to ensure that the user removes only one towelette at a time.

These and further and other objects and features of the invention are apparent in the disclosure, which includes the above and ongoing written specification, with the drawings.

BRIEF DESCRIPTION OF THE DRAWINGS

FIG. 1 is a plan view of a locking trap door embodiment in a towelette access position.

FIG. 2 is a cross-sectional elevation of the apparatus shown in FIG. 1.

FIG. 3 is a plan view of a locking trap door embodiment in a towelette dispensing position.

FIG. 4 is a cross-sectional elevation of the apparatus shown in FIG. 3.

FIG. 5 is a plan view showing a multiple lobe orifice.

FIG. 9 is a perspective view of the dual lid shown in FIGS. 6–8.

FIG. 10 is an opened perspective view of the dual lid shown in FIGS. 6–9.

FIG. 11 shows adjusting the inner lid in a perspective view of the dual lid shown in FIGS. 6–10.

FIGS. 20–24 are plan view details of different lobe designs for towelette dispensing orifices in towelette dispenser caps.

FIGS. 25 and 26 show slitted soft thermoplastic elastomer layers below the dispensing orifice and thermoplastic lobes.

DETAILED DESCRIPTION OF THE PREFERRED EMBODIMENTS

Figures 6, 7, 8:
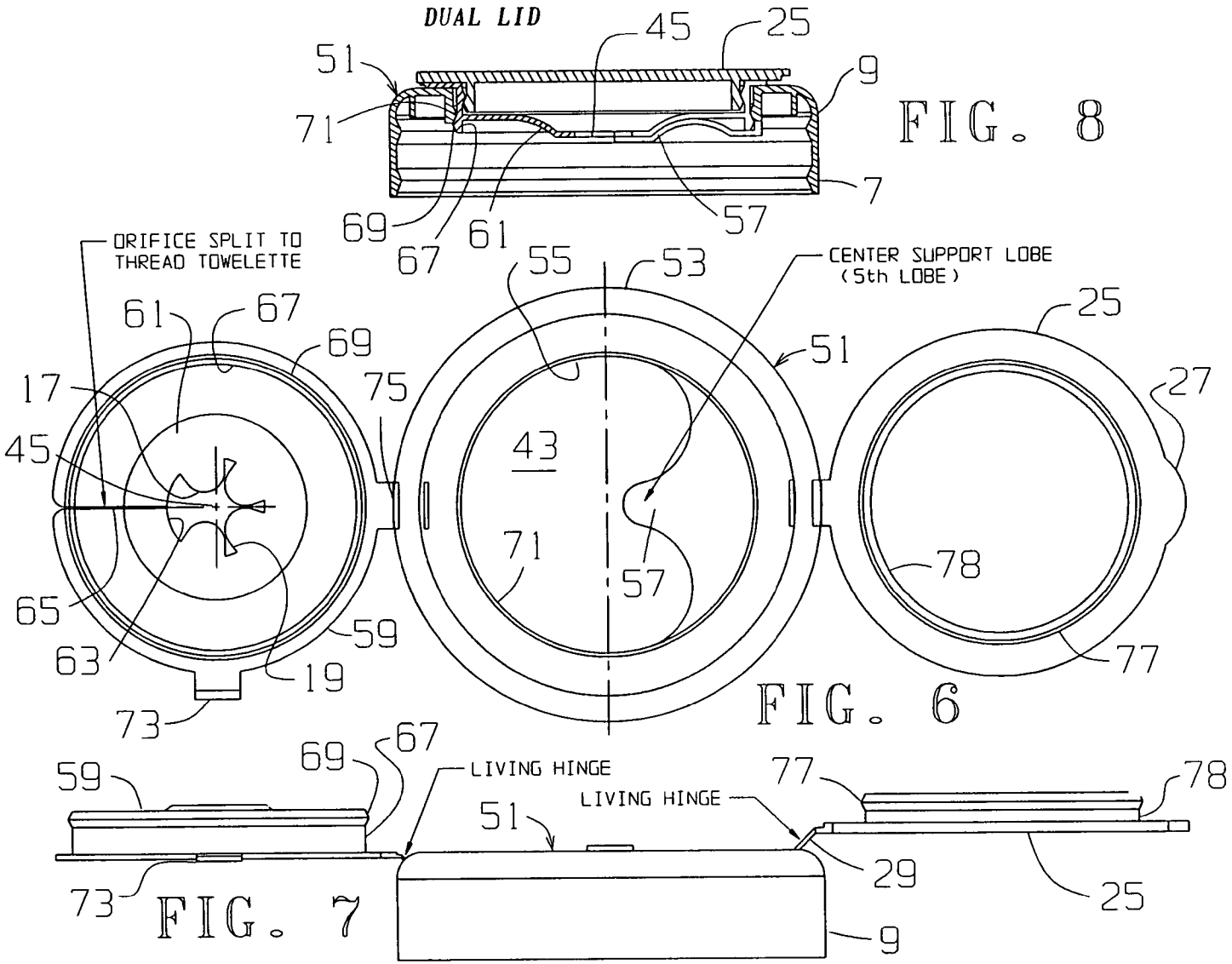
FIG. 6 is a plan view of a dual lid.
FIG. 7 is a side elevation of the dual lid shown in FIG. 6.
FIG. 8 is a closed cross-sectional elevation of the dual lid shown in FIGS. 6 and 7.

Referring to FIGS. 1–4, a trap door embodiment of the invention is generally referred to by the numeral 1. A container 3 has an open upper end 5 that is configured to receive a complementary lower end 7 of the cylindrical wall 9 of the dispenser 1. The dispensing top 11 has two mirror-imaged portions 13 pivoted on living hinges 15. Each half 13 has a dish shape with product-engaging lobes 17 formed between generally radially extending recesses 19. Elongated recesses 21 are formed along the parting line 23 of the two dish-shaped halves 13. A cover 25 with a lifting tab 27 is joined with the top about a living hinge 29. The tab 27 lies within a recess 31 when closed.

In one embodiment, an inward-extending tab 33 cooperates with a rim 35 on the top of the container and extends between two living hinges 37 to assist in holding the cover 25 fully opened or fully closed. Door lock stops 39 extend inward from the central opening 41 to prevent upward travel of the dish-shaped halves 13. When accessing the inner towelette 43 in a roll 44, an index finger and a thumb push inward on the dish-shaped halves 13, which rotate around the living hinges 15 to allow pinching of the top of the innermost towelette 43, and lifting the towelette upward. The lobes 17 and radial recesses 19 and 21 allow the innermost towelette 43 to be pulled through the central opening 45.

Towelettes in the roll 44 are joined together by four or five small bridges. As the next adjacent towelette passes through the central opening 45, the lobes 17 and radial recesses 19 grip and slow the next adjacent towelette while the bridges rupture by continued pulling of the first towelette. The result is that the second towelette protrudes slightly through the opening 45 so that it may be gripped between a thumb and index finger when the next towelette is desired. Between uses, the cover 25 is snapped into closed position, retaining the moisture in the towelettes.

FIG. 5 shows an alternate form of the orifice 45 in which the radial recesses 19 and 21 in the halves 13 are of equal size, making the lobes 17 of equal size.

FIGS. 6–8 show a dual lid embodiment. The lower portion 7 of the cylindrical wall 9 is configured for snapping onto the moist towelette container. When the container is square or rectangular, the wall 9 and the lower end attachment are square or rectangular. The main portion 53 has a central opening 55 with a center support lobe 57, which extends into the opening. An orifice-holding lid 59 has a central portion 61 with lobes 17 separated by radial recesses 19, and a relatively large recess 63 with a radial split 65 used to thread the towelette. A throat 67 has an outward-extending rim 69, which snaps between an inward-extending rim 71 in the central portion 53. A tab 73 is provided to lift the orifice lid 59 around living hinge 75 if required. The split 65 and the large opening 63 align over the center support lobe 57, which provides the fifth lobe which cooperates with the four other lobes 17, forming a towel-lifting opening 45 in the center. When it is necessary to reach the innermost towelette 43, pressing inward on the lobe 17 near the central lobe 57 allows the split 65 to open for reaching the innermost towelette 43. Pulling that towelette upward through the opening 45 and continuing the upward pulling of the towelette draws the next adjacent towelette partially through the opening until the towelette bridges are ruptured. The result is that the next adjacent towelette is partially extended through the opening 45, allowing the next towelette to be conveniently removed through the orifice, and holding the end of the succeeding towelette in the orifice. A cover 25 similar to the cover shown in FIGS. 1–4 is connected to the container end with a living hinge 29. A tab 27 aids in opening the cover. A rib 77 extends around an outside of the throat 78 of the cover for cooperating with an inward-extending lip 79 on the throat of the orifice-holding lid 59.

FIGS. 9, 10 and 11 are perspective views of the container end 51 with the cover 25 raised and the orifice holder 59 closed.

FIG. 10 shows an orifice holder 59 raised with the innermost towelette 43 being pulled from the towelette roll 44.

The orifice holder is shown with the slit 65 separated to aid in the lateral placement of the towelette 43 through the orifice 45.

FIG. 11 shows the closing of the orifice holder 59 while partially pulling the first towelette 43 through the orifice 45.

Figure 12:
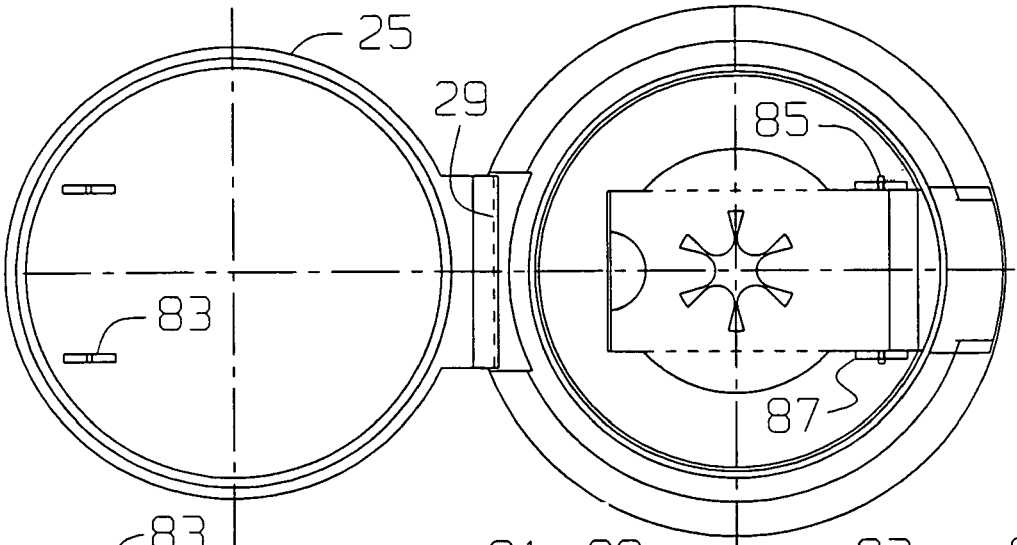
FIG. 12 is a plan view of a towelette access cover and pop-up orifice.
Figure 13:
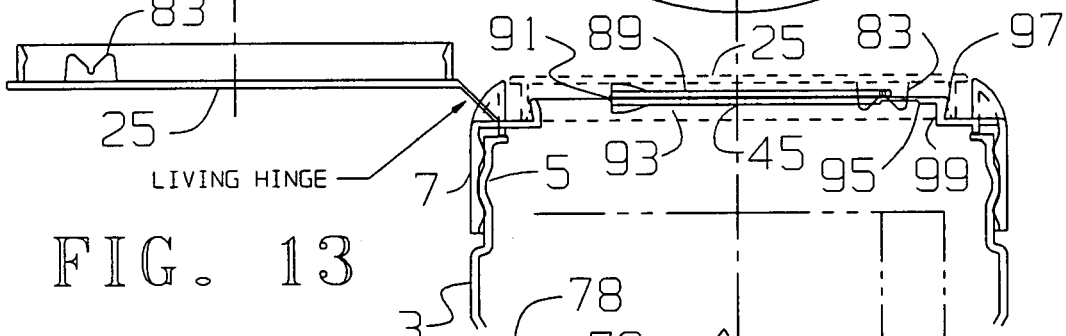
FIG. 13 is a cross-sectional elevation of the towelette access cover and pop-up orifice of FIG. 12.
Figure 14:
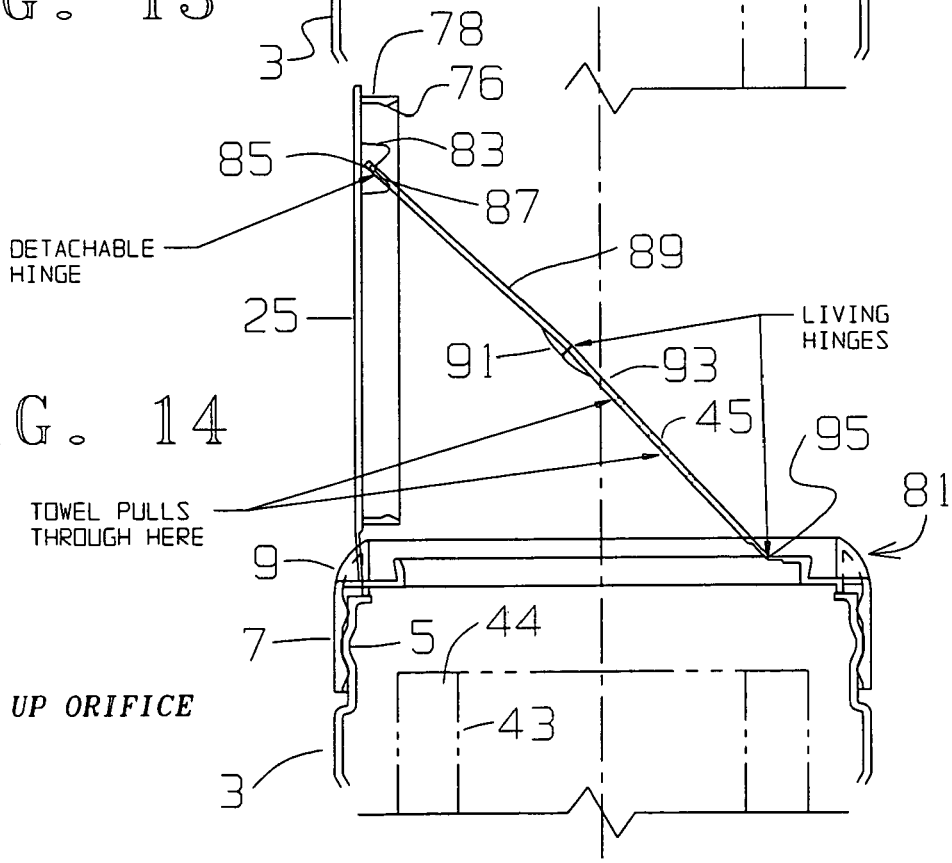
FIG. 14 is an erected cross-sectional elevation of the towelette access cover and pop-up orifice of FIG. 12.

FIGS. 12–14 show a cap 81 of the invention with a pop-up orifice. The container 3 has an upper end 5 with a shape that is gripped by the shaped lower end 7 of the wall 9. A cover 25 is connected to the wall 9 by a living hinge 29. The cover has parallel V-shaped receiver brackets 83 on its inner surface, which receive outward-extending pins 85 on detachable hinge 87 at the outer end of the hinge plate 89. Living hinges 91 connect the hinge plate 89 to the orifice plate 93, which is in turn connected by a living hinge 95 to the top of the container. As the container is packaged, the hinge plate 89 may be folded around the living hinge 91 inward in the container. The orifice plate 93 and hinge plate 89 are lifted around the living hinge 95, and the innermost towelette 43 from the roll 44 is started through the orifice 45. Then the hinge pins 85 are connected to the V-shaped receivers 83 on the cover 25, as shown in FIG. 14. The drawing of the towelette upward through the orifice 43 draws the next connected towelette from the inner surface of the roll 44 until the bridges connecting the towelette are fractured into the resistance of the orifice 45. The cover 25 is closed, folding the hinge plate 89 around the living hinge 91 on top of the orifice plate 93 as the cover is closed, as shown in dashed lines in FIG. 13. An inner lip 76 on the throat 78 of the cover snaps around an outward projection 97 at the inner portion of the orifice holder plate 99, which holds the living hinge 95 in the cap 81.

Figure 16:
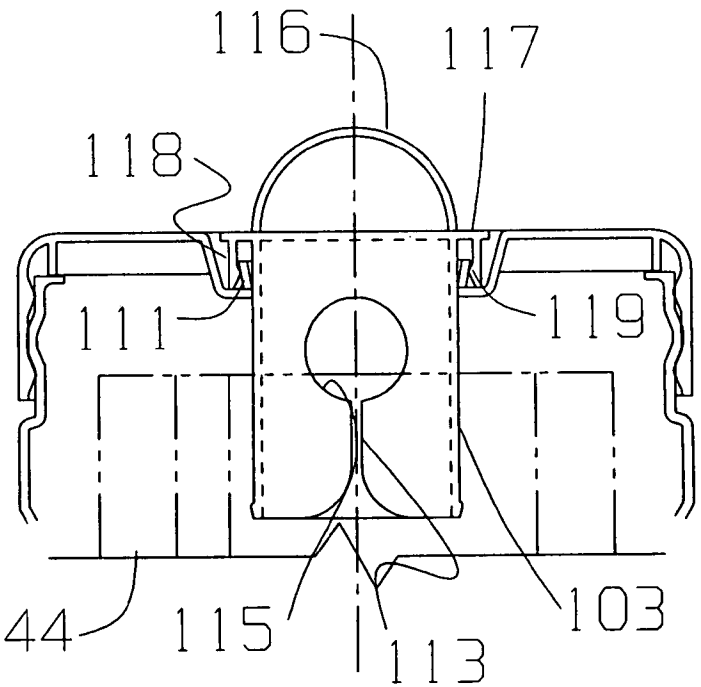
FIG. 16 is a cross-sectional elevation of a telescoping dispenser orifice for towelettes in a closed position.
Figure 15:
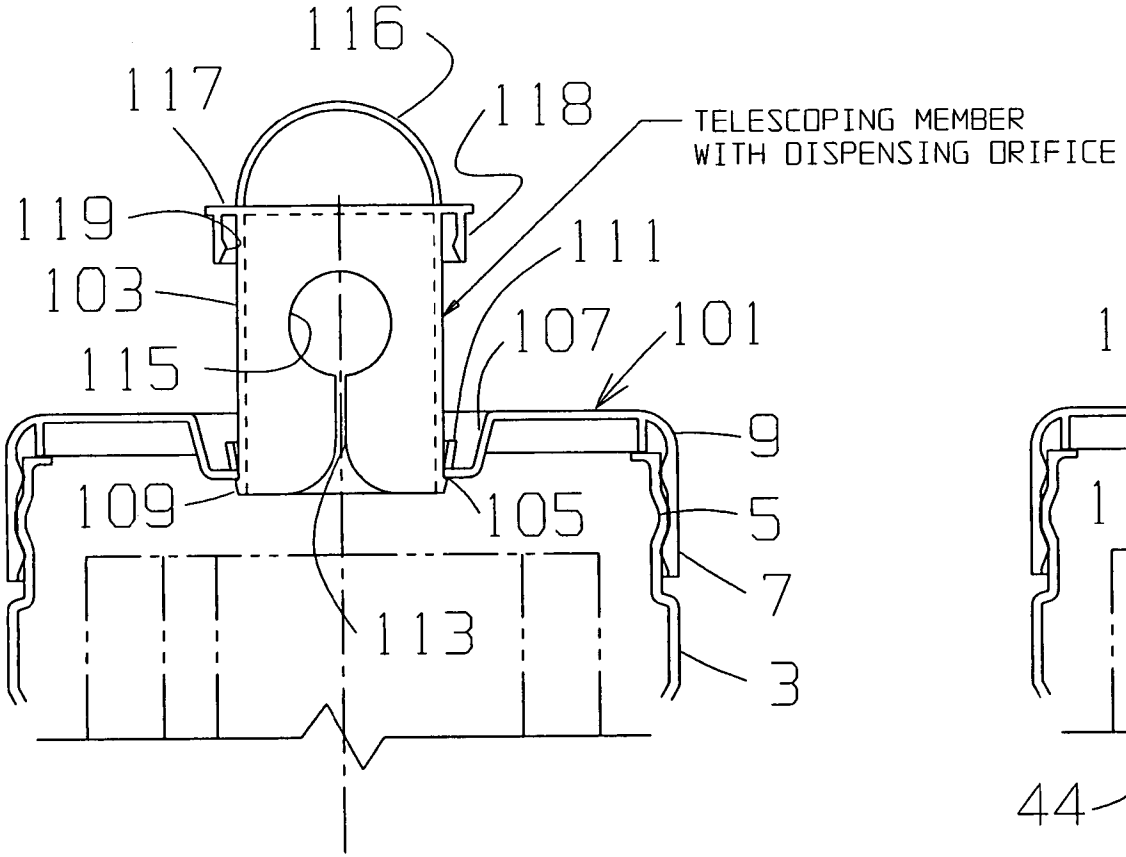
FIG. 15 is a cross-sectional elevation of a telescoping dispenser orifice for towelettes in an extended dispensing position.

FIGS. 15 and 16 show a cap 101 with a telescoping member 103, which fits through a central opening 105 in a central recess 107. A rim 109 at the bottom of the member 103 prevents or retards withdrawal of the member 103 through the central opening 105 in the recess 107. A funnel-shaped guide 111 cooperates with the sloped wall of the rim 109 to permit assembly of the telescoping member in the central opening 105. The sliding member has a central opening 113 that leads to an enlarged orifice 115, through which a lead towelette is pulled from the center of the roll 44. A top 117 of the sliding member 103 substantially fills the central depression 107. A hinged handle 116 extends upward from the top 117, and a throat 118 extends downward and has an inward rib 119, which snaps over an outer edge of the guide 111 to retain the telescoping member in inward position, as shown in FIG. 16.

When using the telescoping member, the cap may be removed and the innermost towelette on the roll 44 may be fed through the central opening 113 and out through the orifice 115 to start the dispensing. Lifting bail 116 raises the telescoping member 103 and the orifice 115, and makes the innermost towelette available for pulling from the orifice. As the towelette leaves the orifice and pulls the end of the next towelette through the orifice, increased resistance causes the towelette bridges to break, leaving the second towelette partially exposed for pulling outward through the orifice. Simply pushing in on the top 117 of the telescoping member 103 closes the container.

Figure 17:
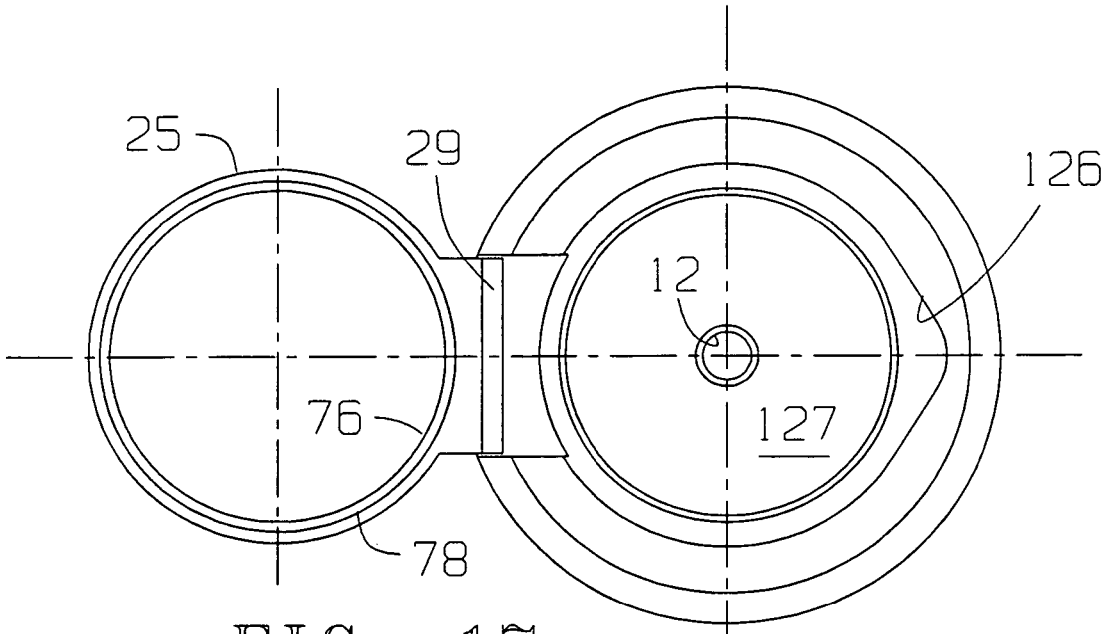
FIG. 17 is a plan view elevation of a dispensing cap thermoplastic elastomer dispenser orifice for towelettes.
Figure 18:
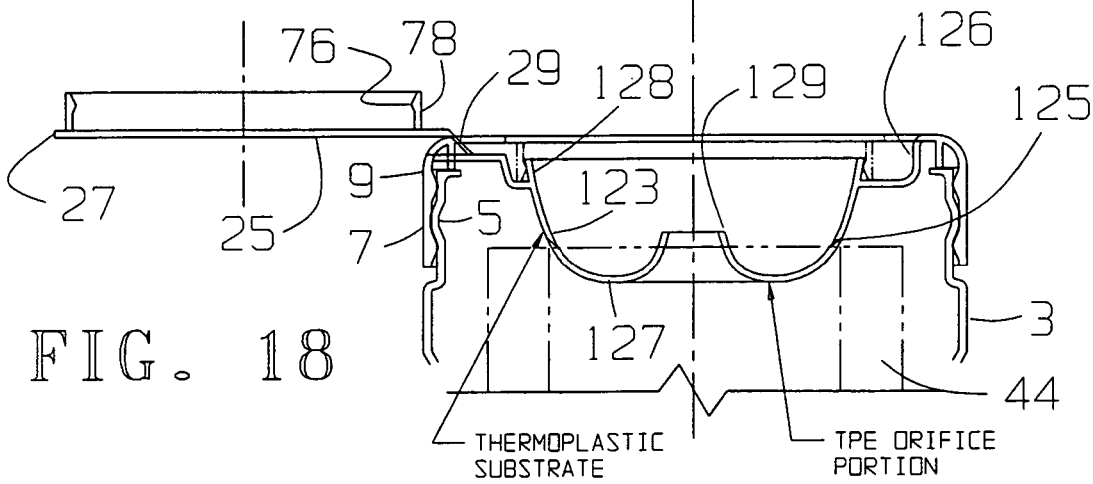
FIG. 18 is a cross-sectional view of the dispensing cap shown in FIG. 17.

One cap 121, as shown in FIGS. 17 and 18, has an integrally molded central dish 123, which is connected at parting line 125 with a soft, relatively flexible orifice portion 127, which contains the orifice 129. Reaching down through the orifice 129 stretches the orifice and allows the user to grasp the innermost towelette on roll 44 and pull the towelette through the orifice. As the next succeeding towelette begins to pull through the orifice, the resistance increases and the bridges between the towelettes tear, leaving a short portion of the successive towelette on top of the orifice. Closing the cover 25 around living hinge 29 enables the inward-extending rim 76 on throat 78 to engage the outward extension 126 on the portion 128 of the thermoplastic substrate 123, which extends above the shelf 122. A recess 126 permits the lifting of the remote edge 27 of the cover when the cover is closed.

Figure 19:
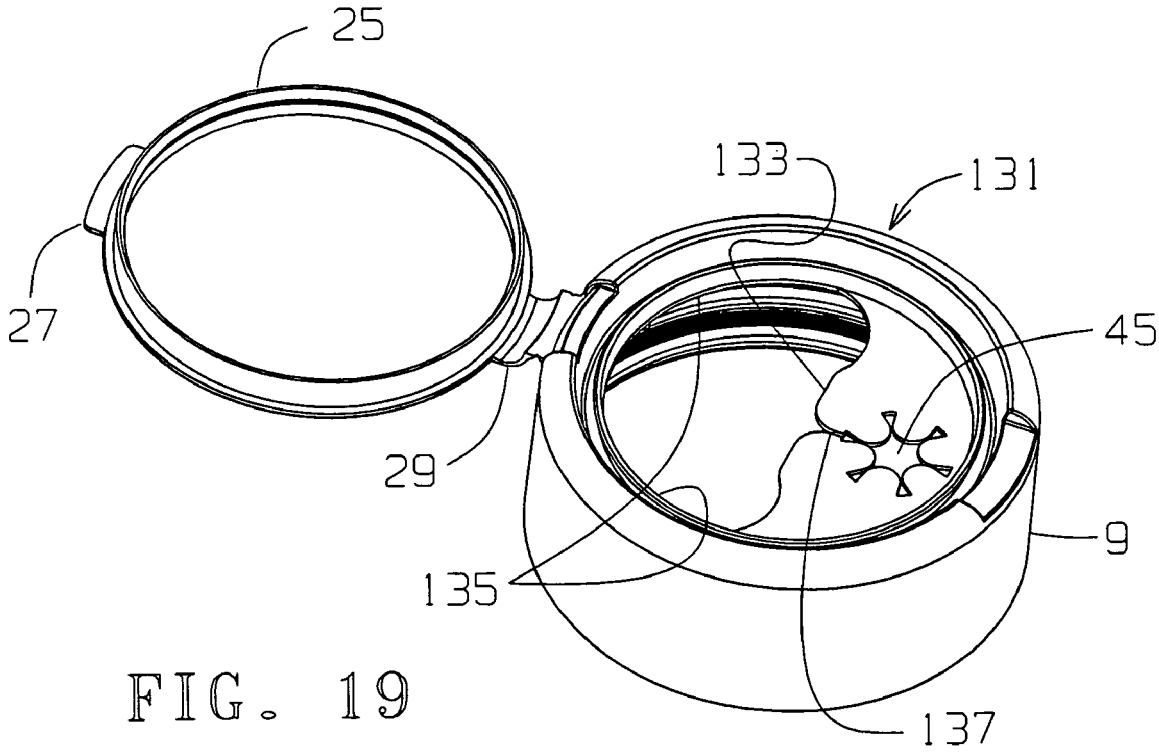
FIG. 19 is a perspective view of a dispensing cap.

In one embodiment of the invention shown in FIG. 19, cap 131 has a sidewall 9 and an inward extending orifice shelf 133, in which the orifice 45 is formed. A large opening 135 is provided in the cap 131 through which the innermost towelette in the underlying roll may be grasped and slid laterally through a slot 137 into the orifice 45. Cover 25 is mounted on living hinge 29 to close the cap 131 and the underlying container.

FIGS. 20–24 show varied orifices and lobe shapes.

FIG. 20 shows an orifice 45 with five lobes 17 and five thin triangular recesses 19 extending radially from the center of the orifice.

FIG. 21 shows an orifice 45 with six similar lobes 17 spaced between triangular shaped recesses 19 leading outward from the center of the orifice.

FIG. 22 shows a circular orifice 145 with four curved lobes 147 between four curved slots 149.

FIG. 23 shows an orifice 45 similar to the orifice shown in FIG. 20, with five lobes 17 and with enlarged radial recesses 19.

FIG. 24 shows an orifice 45 with round laterally touching lobes 17 and circumferentially enlarged recesses 19.

FIGS. 25 and 26 show an orifice 45 similar to the orifice shown in FIG. 20, with five lobes 17 and five triangular radially extending recess slots 19 formed in an orifice thermoplastic shelf 151. Immediately beneath the shelf is a TPE layer 153 with radial slits 155, which cooperate with the orifice 145 to allow passage and encourage gripping of the innermost towelette.

Figure 27:
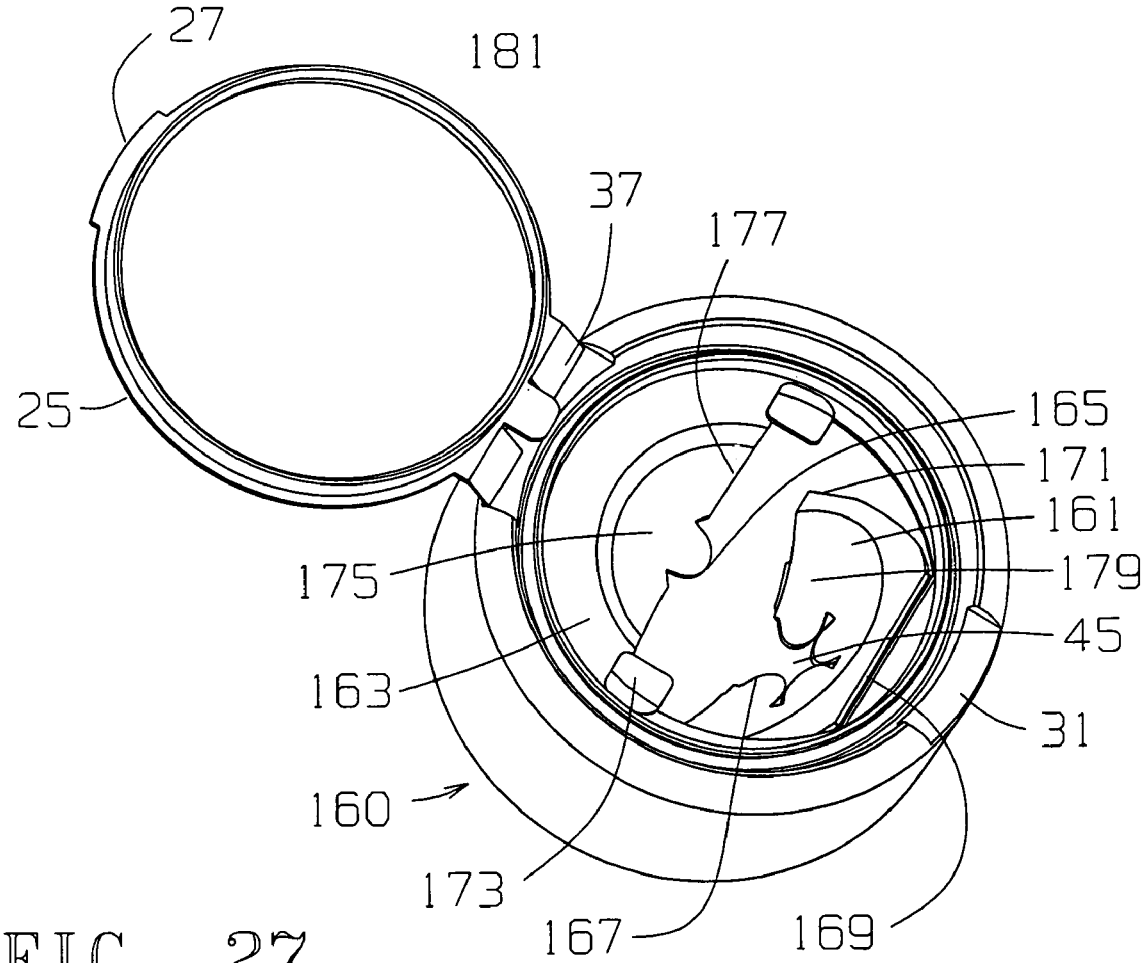
FIG. 27 is a perspective view of a single trap door embodiment.
Figures 28, 29, 30, 31:
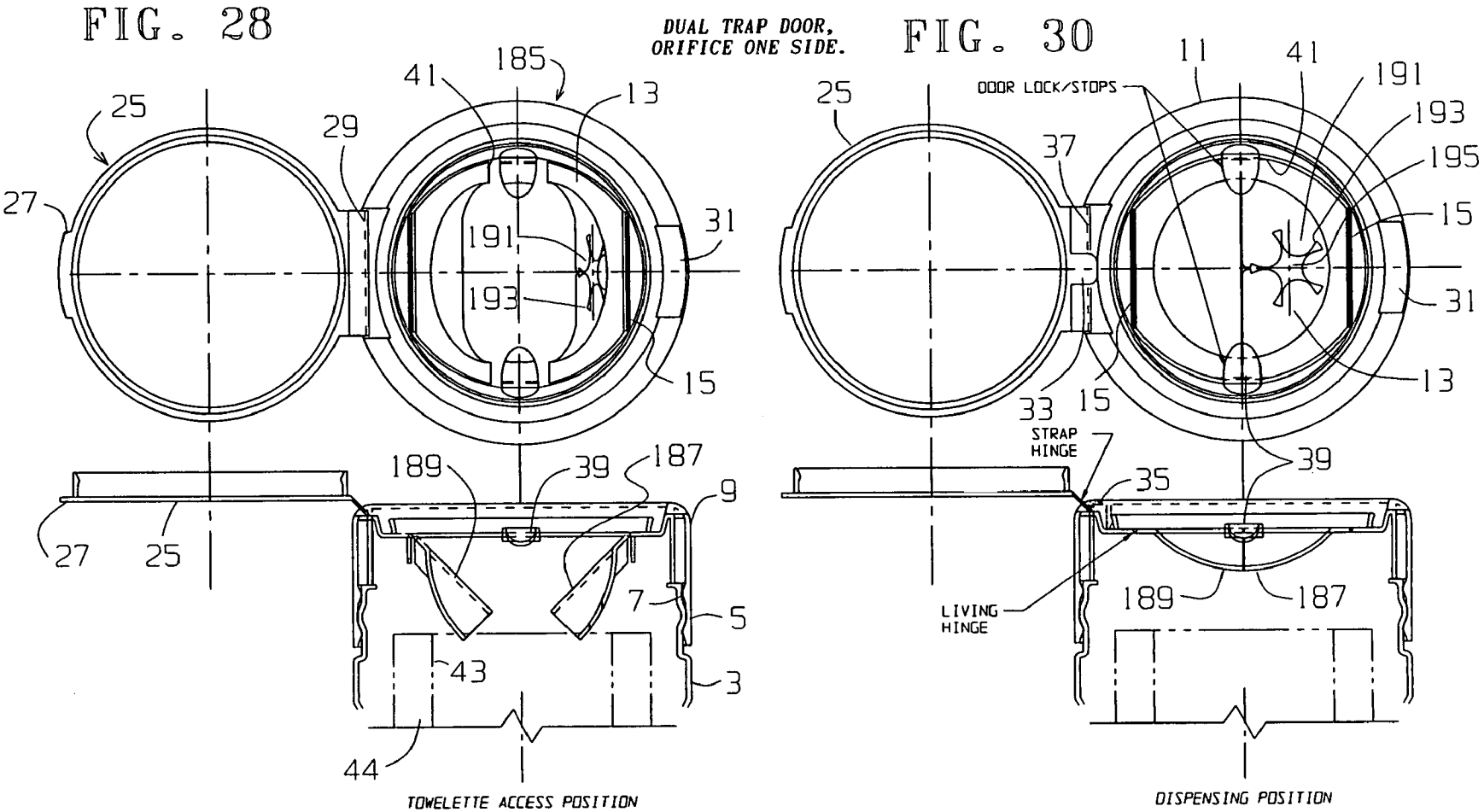
FIG. 28 is a top view of an open dual trap door embodiment with an orifice on one side.
FIG. 29 is a side view of an open dual trap door embodiment with an orifice on one side.
FIG. 30 is a top view of a closed dual trap door embodiment with an orifice on one side.
FIG. 31 is a side view of a closed dual trap door embodiment with an orifice on one side.

FIG. 27 shows a single trap door embodiment 160 that has an orifice 45 formed between the trap door 161 and the stationary part 163 and particularly between a lobe 165 formed on the stationary part and lobes 167 formed on the trap door. The trap door swings inward, around living hinge 169. Upward travel is limited by lugs 173 on the stationary part 163 that overlap sides 171 of the trap door 161.

A central depression 175 formed by depressions 177 and 179 in the stationary part and trap door allow part of the next towelette to remain above the orifice 45 when the cover is closed.

In one embodiment, the trap door may flip up or down and may be snapped into its operative position in which the top of a towelette extends through orifice 45.

The embodiment 160, shown in FIG. 27 is similar to the trap door shown in FIGS. 1–4, except that it has only one flip down door instead of two. This single trap door could also flip up as well as down. This additional single door that flips down or up enables the innermost towelette, from a roll, to be started through the orifice.

The rim 181 on cover 25 tightly fits within opening 183 in the cap 160 to seal the container.

Referring to FIGS. 28–31, a dual trap door embodiment of the invention is generally referred to by the numeral 185. A container 3 has an open upper end 5 that is configured to receive a complementary lower end 7 of the cylindrical wall 9 of the dispenser 185. The dispensing top 11 has two trap doors 187, 189 pivoted on living hinges 15. One trap door 187 has a dish shape with five product-engaging lobes 191 and with enlarged radial recesses 193. The other door 189 does not have any product-engaging regions. An orifice 195 is located completely on one trap door 187. This trap door 187 has a slit 197 for easy threading of a towelette 43 from a roll 44. Both doors 187, 189 open to allow a user to reach into the container 3 and thread the next towelette 43 through the orifice 195.

A cover 25 with a lifting tab 27 is joined with the top 11 about a living hinge 29. The tab 27 lies within a recess 31 when closed.

In another dual trap door embodiment, an inward-extending tab 33 cooperates with a rim 35 on the top of the container and extends between two living hinges 37 to assist in holding the cover 25 fully opened or fully closed. Door lock stops 39 extend inward from the central opening 41 to prevent upward travel of the dish-shaped halves 13. When accessing the inner towelette 43 in a roll 44, an index finger and a thumb push inward on the dish-shaped halves 13, which rotate around the living hinges 15 to allow pinching of the top of the innermost towelette 43, and lifting the towelette upward. The lobes 191 and radial recesses 193, located on only one of the trap doors 187, allow the innermost towelette 43 to be pulled through a slit 197 and a central opening 195.

Towelettes in the roll 44 are joined together by four or five small bridges. As the next adjacent towelette 43 passes through the central opening 45, the lobes 191 and radial recesses 193 grip and slow the next adjacent towelette while the bridges rupture by continued pulling of the first towelette. The result is that the second towelette protrudes slightly through the opening 195 so that it may be gripped between a thumb and index finger when the next towelette is desired. Between uses, the cover 25 is snapped into closed position, retaining the moisture in the towelettes.

Figures 32, 33:
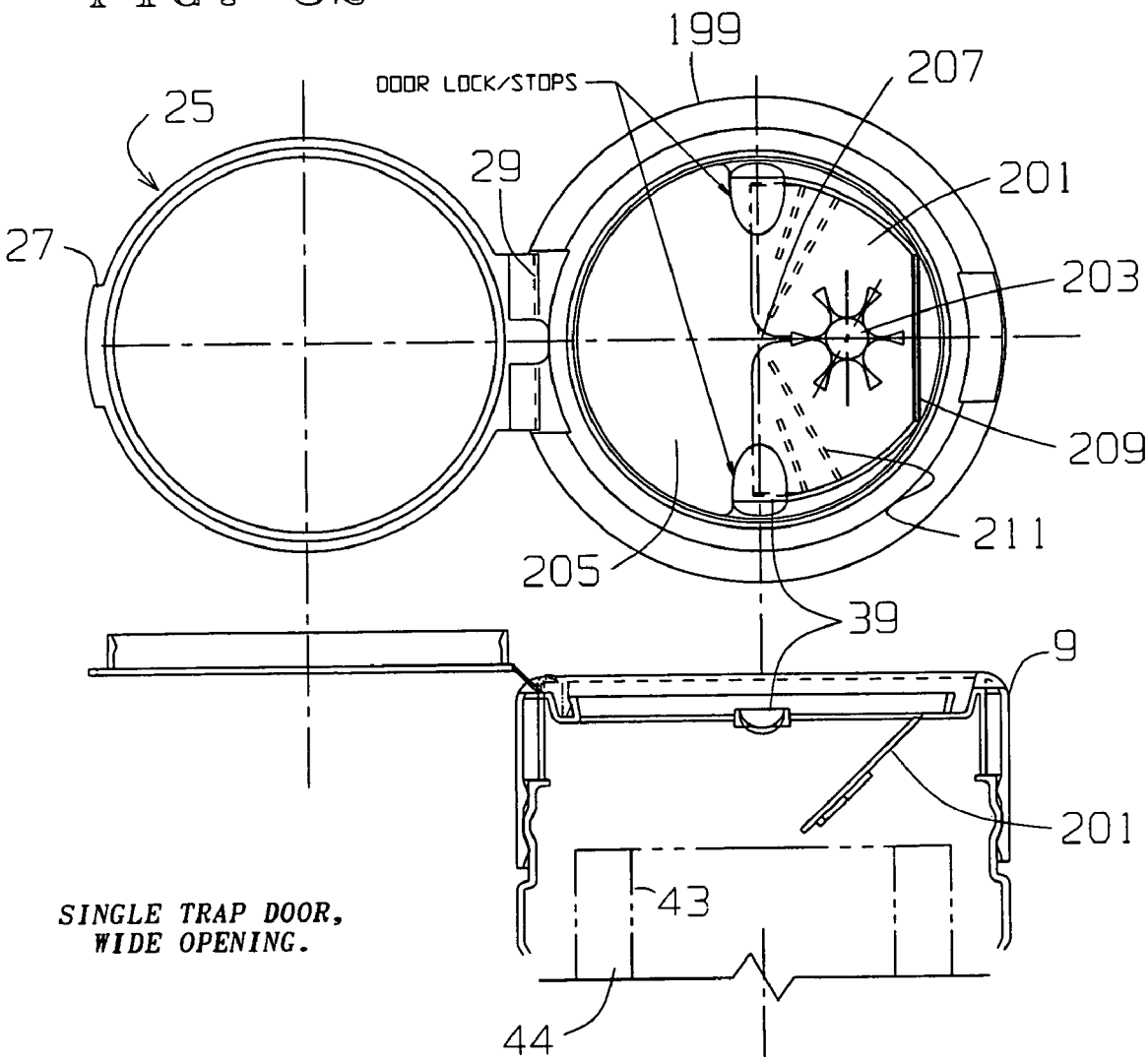
FIG. 32 is a top view of a single trap door embodiment with a wide opening.
FIG. 33 is a side view of a single trap door embodiment with a wide opening.

In a further embodiment of the invention, as shown in FIGS. 32 and 33, a cap 199 has a sidewall 9 and a single inward extending trap door 201, in which an orifice 203 is formed. The trap door 201 is connected to the container via a living hinge 209. The trap door 201 has stiffening ribs 211 on the underside of the trap door 201 for added structural support. A large opening 205 is provided in the cap 199 through which the innermost towelette 43 in the underlying roll 44 may be grasped and slid laterally through a slot 207 into the orifice 203. The trap door 201 opens by pivoting down along the living hinge 209 during towelette retrieval and snaps back into position with door locks 39 for dispensing. The opening of the trap door 201 allows for easier access to the roll of towelettes 44. A cover 25 is mounted on a living hinge 29 for closing the cap 199 and the underlying container.

While the invention has been described with reference to specific embodiments, modifications and variations of the invention may be constructed without departing from the scope of the invention.

The invention claimed is:

1. Towelette dispenser apparatus comprising:

multiple towelettes having connections between ends of adjacent individual towelettes, a container for holding the multiple towelettes, an open end on the container, a lid connected to the container positioned over the open end of the container, a cover on the open end for seating the container, an orifice in the lid for passing towelettes out of the container, one or more lobes protruding into the orifice, wherein a first towelette and a leading portion of a subsequent towelette are pulled through the orifice, and the connections between the first towelette and the subsequent towelette are separated, wherein a leading portion of the subsequent towelette remains outside of the lid and secured within the orifice, and wherein the lid comprises two trap doors, further comprising door lock stops for holding the trap doors in a dispensing position.

2. The apparatus of claim 1, wherein the two trap doors are connected to the lid at opposite edges of the lid.

3. The apparatus of claim 2, wherein the trap doors are connected to the lid by living hinges.

4. The apparatus of claim 1, wherein the orifice is created at the intersection of the two trap doors.

5. The apparatus of claim 4, wherein lobes on each trap door cooperate for holding a leading portion of a towelette.

6. The apparatus of claim 1, wherein the cover is connected to the lid by a living hinge.

7. The apparatus of claim 1, wherein the two trap doors are mirror images.

8. The apparatus of claim 1, wherein the cover overlies the lid when in a closed position.

9. The apparatus of claim 1, wherein the lobes pinch the leading portion of a towelette.

10. The apparatus of claim 1, wherein a living hinge connects the lid to the container.

11. The apparatus of claim 10, further comprising a slot in the lid for threading towelettes.

12. The apparatus of claim 1, wherein the orifice and lobes are various configurations.

13. The apparatus of claim 1, wherein the orifice further comprises recesses between the lobes.

14. The apparatus of claim 13, wherein the recesses are triangular.

15. The apparatus of claim 13, wherein the recesses are rounded.

16. The apparatus of claim 1, wherein the orifice and lobes are curved lobes between curved slots.

17. Towelette dispenser apparatus comprising:

multiple towelettes having connections between ends of adjacent individual towelettes, a container for holding the multiple towelettes, an open end on the container, a lid connected to the container positioned over the open end of the container, a cover on the open end for sealing the container, an orifice in the lid for passing towelettes out of the container, one or more lobes protruding into the orifice, wherein a first towelette and a leading portion of a subsequent towelette are pulled through the orifice, and the connections between the first towelette and the subsequent towelette are separated, wherein a leading portion of the subsequent towelette remains outside of the lid and secured within the orifice, and wherein the orifice and lobes are lobes and wherein triangular recesses are formed in an orifice thermoplastic shelf and below the shelf is an elastomer layer with radial slits.

18. The dispenser of claim 17, wherein two dispensing portions are provided, the dispensing portions being mirror-imaged, and the orifice is defined at the intersection of the dispensing portions by lobes and recesses configured on each of said dispensing portions.

19. The apparatus of claim 17, wherein the towelette dispenser comprises two opposing flaps hinged from opposite sides of the open end of the container and having adjacent edges over the container, and wherein the opening comprises partial complementary openings formed in the adjacent edges.

20. The apparatus of claim 17, wherein the towelettes comprise a roll of towelettes which are dispensed from a middle of the roll.

* * * * *